United States Patent [19]

Phelps

[11] Patent Number: 4,515,735

[45] Date of Patent: May 7, 1985

[54] SLOTTED SPLASH BARS FOR GAS LIQUID CONTACT APPARATUS

[76] Inventor: Peter M. Phelps, 15 Buckeye Way, Kentfield, Calif. 94904

[21] Appl. No.: 548,691

[22] Filed: Nov. 4, 1983

Related U.S. Application Data

[63] Continuation-in-part of Ser. No. 428,438, Sep. 29, 1982, abandoned.

[51] Int. Cl.[3] ..... B01F 3/04

[52] U.S. Cl. ..... 261/111; 261/DIG. 11

[58] Field of Search ..... 261/111, 112, DIG. 11, 261/DIG. 72

[56] References Cited

U.S. PATENT DOCUMENTS

| | | | |
|---|---|---|---|
| 2,542,681 | 2/1951 | Kinney et al. | 261/DIG. 72 |
| 3,389,895 | 6/1968 | De Flon | 261/111 |
| 3,468,521 | 9/1969 | Furlong et al. | 261/DIG. 11 |
| 3,643,931 | 2/1972 | Henning et al. | 261/112 X |
| 3,647,191 | 3/1972 | Fordyce | 261/DIG. 11 |
| 3,879,502 | 4/1975 | Furlong et al. | 261/DIG. 11 |
| 3,969,447 | 7/1976 | Glitsch et al. | 261/111 |
| 4,020,130 | 4/1977 | Ovard | 261/DIG. 11 |
| 4,107,241 | 8/1978 | Braun | 261/112 X |
| 4,133,851 | 1/1979 | Ovard | 261/111 |
| 4,171,334 | 10/1979 | Reiter | 261/112 |
| 4,181,691 | 1/1980 | Cates et al. | 261/DIG. 11 |

FOREIGN PATENT DOCUMENTS

| | | | |
|---|---|---|---|
| 1965230 | 7/1970 | Fed. Rep. of Germany | 261/111 |
| 41-22374 | 12/1966 | Japan | 261/111 |
| 1123 | of 1911 | United Kingdom | 261/DIG. 11 |
| 781242 | 8/1957 | United Kingdom | 261/DIG. 11 |

*Primary Examiner*—Richard L. Chiesa

*Attorney, Agent, or Firm*—Flehr, Hohbach, Test, Albritton & Herbert

[57] ABSTRACT

A cooling tower splash bar which includes an elongate generally flat splash plate section and a structural rib longitudinal to the splash plate section. The rib is integral with and projects along the axis of the splash plate section. In one embodiment the splash bar is generally T-shaped, and in another embodiment it is a generally squared U-shaped configuration. In still another embodiment it is a cross-shaped configuration. Multiple spaced slots are provided in the rib sections to permit firm engagement with the transverse horizontal string wire of a cooling tower. The slots are at a substantial angle off perpendicular from the splash plate section to provide stability against upward air drafts. Preferably, the slots include enlarged entrances to facilitate registry of the slots and string wire.

9 Claims, 8 Drawing Figures

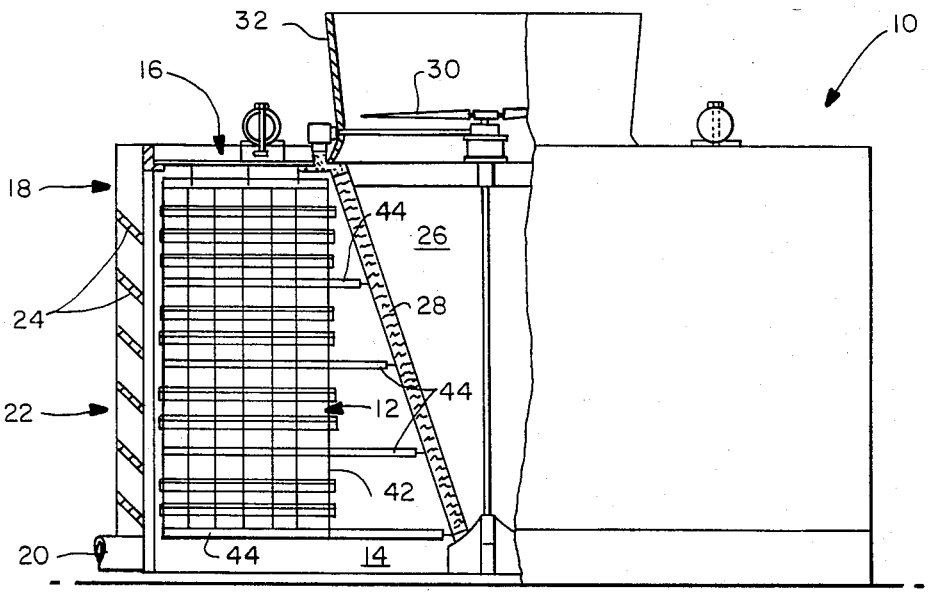
FIG.—1
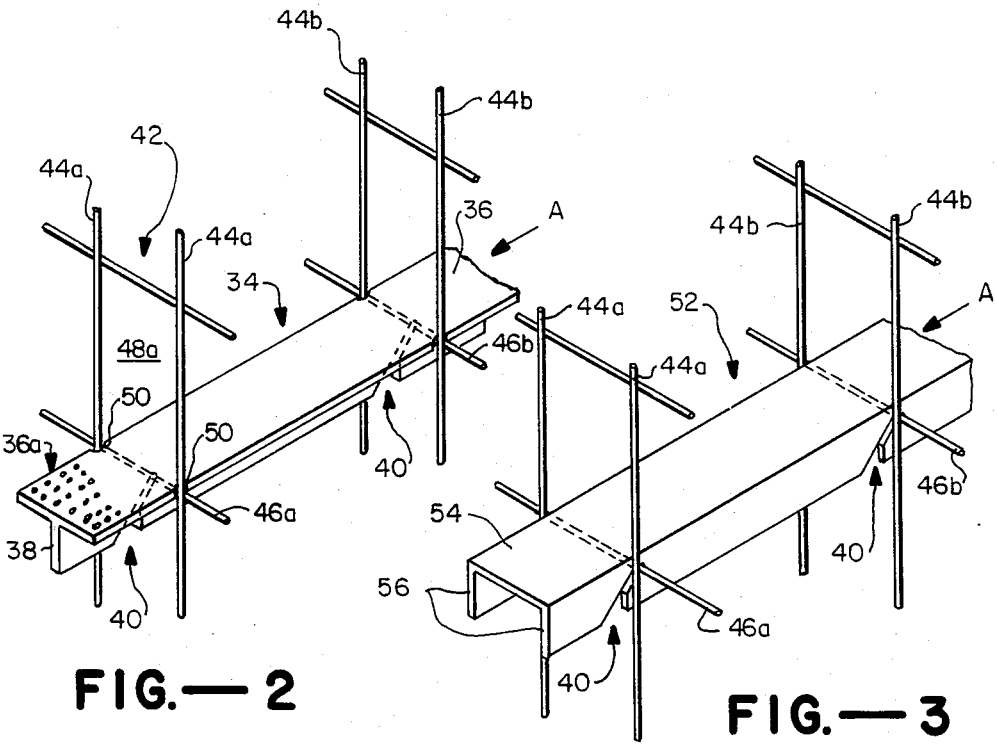
FIG.—2
FIG.—3

SLOTTED SPLASH BARS FOR GAS LIQUID CONTACT APPARATUS

CROSS-REFERENCE TO RELATED APPLICATIONS

This application is a continuation-in-part of my copending application Ser. No. 428,438, filed Sept. 29, 1982, and now abandoned.

BACKGROUND OF THE INVENTION

The invention relates to splash bars useful in crossflow cooling tower and, particularly, to splash bars with positioning slots.

In general, splash bars are used in cooling towers to cause gravitating water to splash and enhance the area of water exposed to a crossflowing air stream inside a cooling tower of either a mechanical or a natural draft type. In one cooling tower splash bar fill, the bars are aligned in a generally parallel direction with the flow of the air stream. The advantage of such alignment is that it exposes a relatively smaller area of fill section to the air stream than would bars aligned across the air stream. This facilitates movement of air through the cooling tower. Typically, the splash bars are supported on transverse grids of spaced vertical and horizontal wires forming windows through which the splash bars project. The horizontal wires support the splash bars along the vertical wires alignment. Various configurations of splash bars are illustrated in De Flon U.S. Pat. No. 3,389,895, Furlong et al. U.S. Pat. No. 3,468,521, Fordyce U.S. Pat. No. 3,647,191, Ovard U.S. Pat. No. 4,020,130, Ovard U.S. Pat. No. 4,133,851, Cates et al. U.S. Pat. No. 4,181,691, and Japanese Pat. No. 22374/1966.

Some of the foregoing references disclose the use of small notches in the bar to assist positioning of the splash bar at the desired crossing points of the vertical and horizontal wires. This is illustrated in U.S. Pat. Nos. 4,133,851 and 4,181,691. However, the notches do not provide stability to positively anchor the bars to the hangers during periods of high winds. This is particularly important for splash bars which are manufactured from lightweight material such as plastics. It is not uncommon for a fill bar installer to utilize a clip or tie to fix the bar to the hanger, thus adding to the time of installation and the expense of the project (e.g., see U.S. Pat. No. 3,647,191 at col. 4, line 40).

Another problem with notching in the splash bars of the above patents is that the notches tend to be caught by the wires in the fill hangers as the fill bar is being slid into place before the notches reach the proper wire for fixing the bar in its desired location.

Another shortcoming of the above U.S. Pat. Nos. 4,181,691 and 4,133,851 relates to stiffening ribs which extend upwardly from the horizontal splash plates in position. Thus, in the 4,133,851 patent, the ribs extend upwardly, while in the 4,181,691 patent the legs of the U-shape extend upwardly. The disadvantage is that when the bar is seated between support hangers, the upwardly extending ribs, typically formed of thin plastic material, must take essentially all the bending load in compression rather than in tension, tending to cause thin plastic material to buckle, thus limiting the effective height that such a rib can be extended.

The only reference in which the support ribs project downwardly from the splash portion is Japanese Pat. No. 22374/1966. There, a special hanging wire section is required with intersecting wedge shaped corners so that the sides of the splash section rest on the wires as well as the rib section. This approach is complicated and is subject to the disadvantage of displacement by upward air drafts.

SUMMARY OF THE INVENTION AND OBJECTS

According to the present invention, a splash bar is provided for a cooling tower which includes an elongate, generally flat splash plate section and at least one downwardly extending longitudinal structural rib section. Multiple spaced open slots are provided in the downward rib sections to permit the splash bars to be firmly engaged and supported by a transverse horizontal string wire of the cooling tower. The slots are sloped at a substantial angle off the perpendicular from the axis of rib section to provide stability against upward air drafts from air flowing in the direction opposite to the entrance of the sloped slot. The slot entrance may be enlarged compared to the inner most end of the slot to facilitate registry of the slot and string wire during mounting.

Preferably, the slot projects along the rib section a distance so that the innermost extent of the slot is closely adjacent to splash plate for maximum stability to such upward air drafts. In one embodiment, the splash bar is in a generally T-shaped configuration with the rib forming the upright portion of the T-shape. In another embodiment, the splash bar is a generally square U-shaped configuration with the uprights of the U-shape forming two rib sections. In other embodiments, an upwardly projecting rib section is also provided, forming a cross shape where there is only one downwardly projecting rib.

It is a general object of the invention to provide a structurally stable splash bar for a cooling tower, particularly of the crossflow type, in which the splash bar resists displacement by upward air drafts.

It is a particular object of the invention to provide a splash bar which is readily put into position on a string wire matrix and then is easily mounted in a stable position.

Additional objects and features of the invention will be apparent from the following description taken in conjunction with the appended drawings.

BRIEF DESCRIPTION OF THE DRAWINGS

FIG. 1 is a side elevational view of a crossflow cooling tower using the splash bars of the present invention, with the left hand side of the tower broken away.

FIG. 2 is a perspective view of the T-shaped splash bar embodiment disposed on the support wire grid, while FIG. 3 is the same view of a square U-shaped splash bar embodiment.

DETAILED DESCRIPTION OF THE PREFERRED EMBODIMENTS

Figure 4:
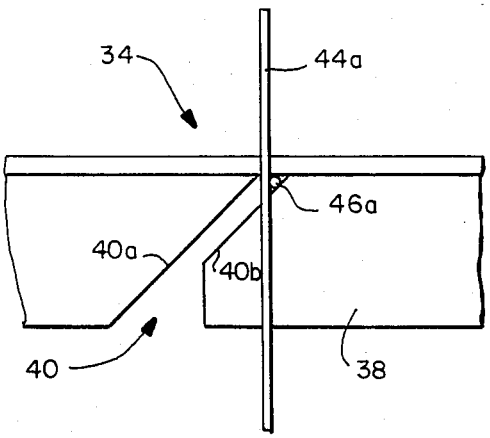
FIGS. 4 and 5 are expanded side views of a portion of the embodiments of FIGS. 2 and 3, respectively.

The crossflow cooling tower illustrated schematically in FIG. 1, with the left hand side partially broken away, is broadly designated by the number 10. The left side only of the tower will be described. The right side is a mirror image of the left side. The unit includes a fill assembly broadly designated by the number 12 and to be described below, a cooled water base 14 disposed below fill assembly 12 to receive water gravitating therefrom, and open top distribution tray 16, positioned directly above fill assembly 12, in location to permit water to gravitate through apertures onto the upper portion of the fill assembly. A housing designated by the number 18 encloses assembly 12 along with basin 14 and tray 16. A pump is operably coupled to basin 14 and tray 16 for removing cooled water from basin 14, delivering the water to equipment requiring the same for cooling, and for returning the thus warmed water to tray 16.

To the left side of the housing is an air inlet opening 22 with air louvers 24. Inward of fill section 12 is a plenum chamber 26 separated from the fill section by an inclined drift eliminiator wall 28 of any conventional type, such as a series of baffles inclined toward the central portion of the fill assembly 12 to permit the free flow of air therethrough but to prevent significant quantities of water droplets to escape therefrom. In the illustrated embodiment, a fan 30 is provided in stack 32 above plenum chamber 26 to cause induced air flow from inlet 22 across fill section 12, and to turn upwardly and out stack 32. If desired, fan 30 may be eliminated for use in a natural induction cooling tower where the air is induced to flow through the fill assembly by means of the natural convection of warm exhaust air rising through plenum chamber 26 and stack 32, or some similar configuration.

Referring to FIGS. 1, 2, and 4, the splash fill assembly 12 will first be described in conjunction with the use of a generally T-shaped configuration splash bar 34, which includes an elongate generally flat splash plate section 36 and a structural rib section 38 integral with section 36 and forming the upright portion of the T. While rib section 38 is illustrated to project along the axis of the splash plate section in the direct center thereof and perpendicular thereto, it should be understood that it could be off center and off the perpendicular and still serve a similar function. Conventional spaced circular openings are provided in splash plate section 36 to pass small droplets therethrough. Splash bar 34 includes multiple longitudinally spaced apart open slots 40, to be described more fully below.

The support for splash bars 34 is a vertically conventional wire matrix or grid, generally designated by the number 42. The grid is typically a plastic coated metal wire. The grid is hung between the upper and lower surfaces of the fill area by horizontal fastening bars 44, to maintain the grid in rigidity and alignment. As illustrated more clearly in FIG. 2, each of the splash bars 34 is hung between at least two vertically disposed wires **44*a*, and is supported by a horizontal wire 46*a* to form a window 48*a* typical of a rectangular configuration. As illustrated in FIG. 2, a second planar matrix is illustrated spaced longitudinally along splash bar 34, with vertical wires designated as 44*b* and horizontal support wires 46*b*. Referring to FIG. 1, seven planar matrixes or grids are shown from left to right, with splash bars 34** supported on corresponding support wires.

Referring to FIGS. 2 and 4, the upright T of the splash bar is supported on the horizontal wire by sliding the splash bar 34 in position to be received by the wires, and then by moving the splash bar so that the wires are received by slots 40. Slots 40 are defined by a slot wall **40*a* sloped at a substantial angle off perpendicular from the longitudinal axis of the rib section, and slot wall 40*b*, usually parallel to slot wall 40*a* at its innermost extent in the illustrated embodiment, slot wall 40*b* including an outer extent generally perpendicular to the longitudinal axis of the rib section. Thus, in general, slot walls 40*a* and 40*b* define an innermost slot slightly larger than the diameter of wire 46*a*, to permit ready sliding of the wire in the slot but to retain the splash bar in a relatively fixed position when mounted on wire 46*a***. Preferably, the outermost extent of the slot at its entrance is enlarged compared to the innermost end of the slot to facilitate registry of the slot and string wire during mounting. While the general configuration of the slot to include the above described angle and the enlarged opening are significant features of the invention, the exact slope and shape of the enlarged opening are not critical to the invention. Suitable disposition for the slot is at an inclination of from about 10° to about 80° off perpendicular to the splash plate. As illustrated, the slope is 45° off perpendicular.

The T-shaped splash bar 34 also includes notches 50 on both outer edges of splash bar section 34 in longitudinal alignment with the innermost extent of the corresponding slots. Such notches serve to further assist in positioning the splash bars at each corresponding grid line. If there is a tight fit between adjacent vertical wires, it may be desirable to form notches on one edge only of the splash plate section to permit the splash bar to be inclined and slid in place on the smooth side.

In the illustrated embodiment, the slots extend to a sufficient depth so that the horizontal wires contact the bottom surface of the splash plate section. This is the point of maximum stability to the system. However, it should be understood that such slot need not project the full distance so long as the innermost extent of the slot is closely adjacent to the splash plate.

The advantages of the above splash bar are many fold. Firstly, the splash bar is positioned with the crosses of the T bearing the full weight on the wire. By projecting the slot to its fullest extent, the dynamic load is spread over the full section of a wide portion of the splash bar, which minimizes problems associated with concentrated load points.

Secondly, in other known towers, when wind is blowing from the outside to the tower, frequently updrafts occur which can displace a conventional splash bar. This is overcome where wind is blowing in direction A in FIG. 2 because the slot is cut on an angle such that the wind tends to wedge the bar against the wire of the hanger at the innermost extent of the slot. If the bar starts to move upwardly, the wire in the hanger impinges against the lower edge of the cut.

Splash bar 34 lends itself to ready installation. That is, the bar may be slid along the horizontal wires in the hanger opening, from hanger to hanger in an upside down position, so that the upper surface of plate 34 is facing downwardly. If the fit between the vertical wires is too close, the splash bar may be tilted slightly off center. When this final position is reached, the splash bar may be inverted to its normal position and the adjacent wire slide into slots 40. Then, in the final position, the notches are in place.

In the illustrated embodiment, splash bars 34 are aligned in a parallel path with the incoming air stream. If desired for a particular application, the fill could be disposed across the air stream.

Referring to FIG. 3, another embodiment of the invention is illustrated in which the splash bar 52 is a generally squared U-shaped configuration including a flat splash plate section 54 and uprights of the U forming rib sections 56. Vertical positioning wires 44*a* and 44*b* and horizontal wires 46*a* and 46*b*, similar to the foregoing, are illustrated. These slots are designated by the number 40 because the description with respect to slots 40 in the T-shaped embodiment of FIGS. 2 and 4 apply in the same manner with respect to the U-shaped embodiment of FIGS. 3 and 5. Similar advantages are achieved with this embodiment as with respect to the T-shaped embodiment. Also, the U-shaped embodiment may be mounted in a similar way, that is, it may be inverted while being slid through the windows of the grid network prior to reaching the final mounting place, where the splash bars are again inverted for mounting.

Figure 6:
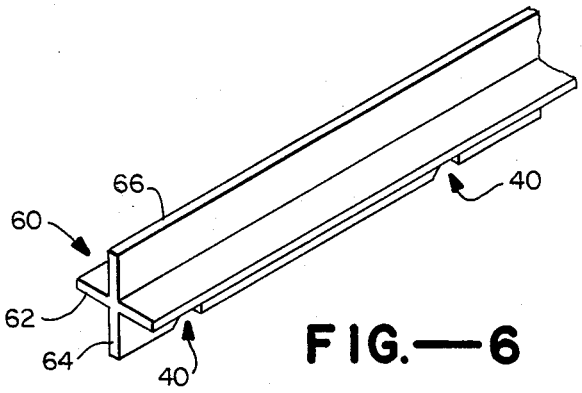
FIGS. 6 and 7 are perspective views of two different embodiments of the splash bar with upwardly directed ribs.

Referring to FIG. 6, a cross-shaped embodiment is illustrated which is similar in many respects to the T-shaped embodiment of FIGS. 2 and 4. Thus, the splash bar generally designated by the number 60 includes a generally flat splash section 62 and at least two structural ribs 64 and 66 longitudinal to the splash plate section. The ribs are integral with the splash plate section and project along its longitudinal axis. Rib 64 projects downwardly from the splash plate and is located in the central portion thereof perpendicular to the splash plate, while rib 66 projects upwardly from splash plate 62 and is aligned with rib 64. Slots are provided in downwardly projecting rib 64 and are designated by the number 40 because the description with respect to slots 40 in the T-shaped embodiment of FIGS. 2 and 4 apply in the same manner with respect to FIG. 6. The splash bar of FIG. 6 is, in essence, a T-shaped configuration with a vertical rib 66 positioned directly above rib 64.

Referring again to FIG. 6, the purpose of rib 66 is to provide structural stability in addition to that provided by rib 64. Rib 66 is optional but is preferably included with relatively thin plastic splash plates 62, which are commonly used. In general, the width of splash plate 60 is longer than the total vertical distance of ribs 64 and 66. However, if desired, the total vertical distance perpendicular to the splash plates may be the same or greater than the width of the splash bars. Rib 66 is particularly beneficial where an area of the splash plate overhangs the supporting crosswire, as illustrated in FIG. 2. That is, the portion of the splash bar to the left of support wire 46*a* may require additional support to prevent drooping. If there were no support, the splash plate could assume a bowed shape leading to deformation of the liquid stream downwardly along the plate, which is less efficient than the spreading of liquid on a horizontal splash plate.

Figure 5:
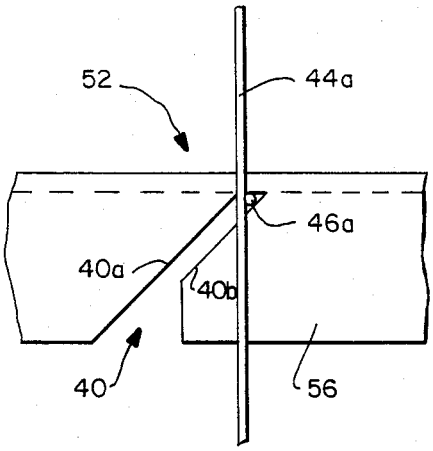
Figure 7:
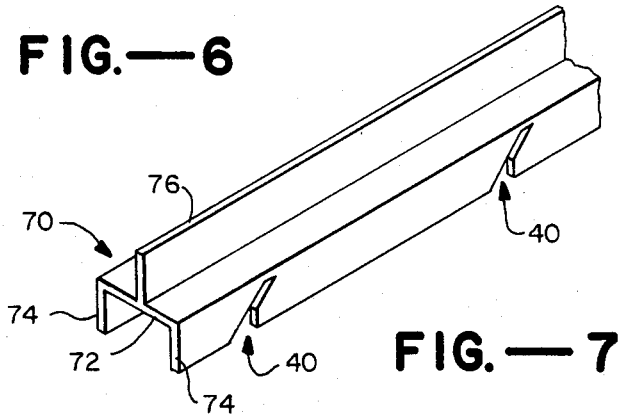

Referring to FIG. 7, another embodiment of the invention is illustrated based upon the U-shaped configuration of FIGS. 3 and 5. The splash bar generally designated by the number 70 includes a flat splash plate section 72 and uprights of the U forming ribs 74. The slots are designated by the number 40 because the description with respect to the slots in the T-shaped embodiment of FIGS. 2 and 4 apply in the same manner with respect to this U-shaped configuration.

The only difference between the embodiment in FIG. 7 and that of FIGS. 3 and 5 is the inclusion of an additional vertical structural rib 76, spaced midway along splash plate 72 and longitudinal therewith. Rib 76 is preferably formed integral with the splash bar and serves a similar function to that of structural rib 66.

Figure 8:
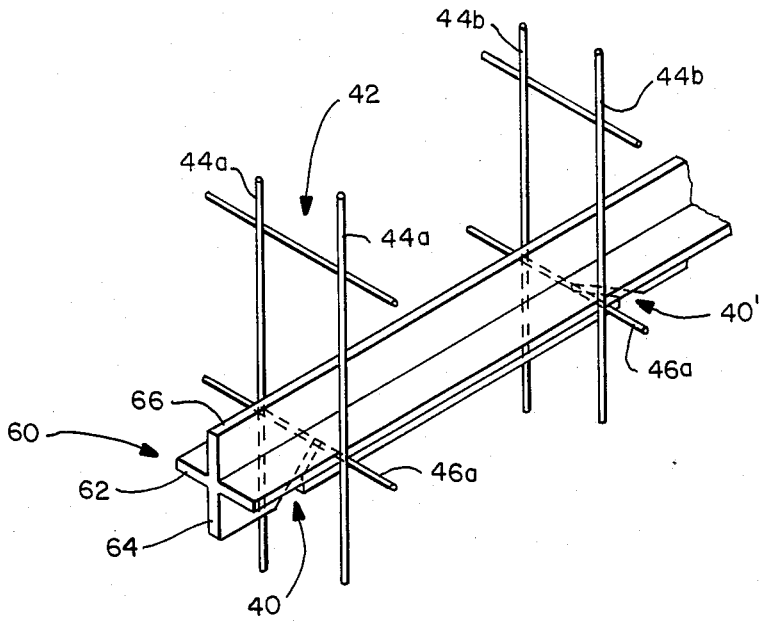
FIG. 8 is a perspective view of an embodiment of the splash bar with slots sloped in opposite directions.

Referring to FIG. 8, another embodiment of the cross-shaped splash bar of FIG. 6 is illustrated supported on a conventional wire matrix or grid of the type illustrated in FIGS. 2 and 3. For simplicity of description, like portions of the splash bar of FIG. 6 and the grid work of FIGS. 2 and 3 are designated by like numbers. The sole difference between the splash bar illustrated in FIG. 8 and that of FIG. 6 is that the slot 40′ to the right hand side of the embodiment illustrated in FIG. 8 is sloped in the opposite direction from slot 40, which slopes in the same direction as slots 40 of the embodiment of FIG. 6. The inclination of slot 40′ is the same as that of slot 40, i.e. as illustrated it is 45° off the perpendicular but may be from 10° to 80° off the perpendicular.

One advantage of using slots with slopes in opposite directions is to provide protection against air currents flowing in directions opposite to the normal direction along the splash bar. One such instance would be where a mechanical draft fan is operated in the reverse direction from its normal one. Thus, the combination of using slots sloping in opposite directions provides a locking mechanism against air flow from either direction so that the splash bars tend to stay in the seated position on the horizontal wires. In the embodiment of FIG. 8, only two slots are utilized. However, if desired, three or more slots may be used with two or more slots sloping in one direction and one or more slots sloping in the opposite direction. The use of slots sloping in the opposite direction are also applicable to the T-shaped splash bar FIG. 2 and the U-shaped splash bar of FIG. 3.

Mounting of the splash bars of FIG. 8 is accomplished generally in the same manner as mounting the embodiments of FIGS. 2 and 3. The only different would be that the wire upon which the opposite directed slot is to be mounted is deflected slightly by pushing in the appropriate direction for mounting. This is no problem because there is substantial flexibility in the wire assembly.

Three different embodiments of the present invention, namely T-shaped, inverted U-shaped and cross-shaped configurations, are illustrated. However, it should be understood that other embodiments may be employed which include an elongate generally flat splash plate section and a longitudinal structural rib section projected along the axis of the splash plate section. For example, such rib sections need not be perpendicular to the splash plate sections so long as they are somewhat transverse to them. Thus, they may be at an angle off the perpendicular. Furthermore, if desired, splash plate sections need not be totally flat but may include some form of curvature or outward taper.

What is claimed is:

1. A cross-shaped splash bar for a cooling tower, said splash bar including an elongate generally flat splash plate section and at least two structural rib sections longitudinal to said splash plate section, said rib sections being integral with and projecting along the axis of said splash plate section, one of said rib sections projecting to one side of said splash plate section and the other rib section projecting to the opposite side of said splash plate section, said two rib sections being aligned with each other, said one rib section defining multiple spaced apart open slots adapted to receive a transverse horizontal string wire of a cooling tower on the lower side of said splash bar, said slots extending from the free edge of said one rib section inwardly toward said splash plate section, each of said slots being sloped at a substantial angle off perpendicular to the longitudinal direction of said one rib section, said slots serving to stabilize the splash bar against wind updrafts when said splash bars are disposed in a cooling tower.

2. The splash bar of claim 1 in which at least two of said slots are sloped in the same direction.

3. The splash bar of claim 1 in which at least two of said slots are sloped in opposite directions.

4. The splash bar of claim 1 together with notches on at least one edge of the splash plate section, in longitduinal alignment with the innermost extent of corresponding slots.

5. The splash bar of claim 1 in which the width of the slot at the slot entrance is enlarged compared to the innermost end of the slot to facilitate registry of the slot and string wire during mounting.

6. The splash bar of claim 1 in which said slot projects along said rib section a distance so that the innermost extent of said slot is closely adjacent to said splash plate.

7. A gas-liquid contact apparatus with a crossflow section including a first upright planar matrix defined by spaced generally horizontal string wires mounted to spaced generally upright string wires defining first windows, a second upright planar matrix defined by spaced generally upright string wires mounted to spaced generally horizontal string wires defining second windows aligned with said first windows, and splash units extending between said first and second windows supported on said horizontal string wires, each of said splash bars including an elongate generally flat splash plate section and at least one structural rib section longitudinal to said splash plate section, said rib section being integral with and projecting along the axis of said splash plate section, said rib section defining multiple spaced apart open slots, said slots extending from the free edge of the rib section inwardly toward said splash plate section, said slots being sloped at a substantial angle off perpendicular from the longitudinal axis of the rib section, said splash units resting on transverse horizontal string wires which are seated at the innermost ends of said slots in registry therewith, to provide stability against upward air drafts from air flowing in a direction opposite the entrance of the sloped slot, said splash bars being in a general cross-shaped configuration, with aligned rib sections projecting above and below the splash plate section, said slots being disposed on the rib sections on the lower side of the splash plate section.

8. The gas-liquid contact apparatus of claim 7 in which at least two of said slots are sloped in the same direction.

9. The gas-liquid contact apparatus of claim 7 in which at least two of said slots are sloped in opposite directions.

* * * * *